US005361739A

United States Patent [19]

Coates

[11] Patent Number: 5,361,739

[45] Date of Patent: Nov. 8, 1994

[54] SPHERICAL ROTARY VALVE ASSEMBLY FOR USE IN A ROTARY VALVE INTERNAL COMBUSTION ENGINE

[76] Inventor: George J. Coates, 1811 Murray Dr., Wall Township, Monmouth County, N.J. 07731

[21] Appl. No.: 60,358

[22] Filed: May 12, 1993

[51] Int. Cl.[5] ..... F01L 7/10

[52] U.S. Cl. ..... 123/190.14; 123/190.2; 123/80 BA

[58] Field of Search ..... 123/190.1, 190.14, 190.15, 123/190.2, 80 R, 80 BA; 251/311, 192

[56] References Cited

U.S. PATENT DOCUMENTS

| | | | |
|---|---|---|---|
| 4,370,955 | 2/1983 | Ruggeri | 123/190.6 |
| 4,944,261 | 7/1990 | Coates | 123/190.14 |
| 4,953,527 | 9/1990 | Coates | 123/190.4 |
| 4,976,332 | 11/1990 | Coates | 123/190.17 |
| 4,989,558 | 2/1991 | Coates | 124/190.14 |
| 5,109,814 | 5/1992 | Coates | 123/190.2 |

*Primary Examiner*—E. Rollins Cross
*Assistant Examiner*—Erick Solis
*Attorney, Agent, or Firm*—Clifford G. Frayne

[57] ABSTRACT

A spherical rotary valve assembly for an internal combustion engine of the piston and cylinder type wherein the spherical rotary valve assembly is positioned within a split cylinder head having an upper and lower section such that when secured defines cavities for a rotational shaft having mounted thereon, an intake drum and an exhaust drum for each cylinder, the lower half of the split head having an inlet port and an outlet port in communication with each cylinder, the cylinder head having an intake passageway and an exhaust passageway in communication with the drum cavities in the split cylinder head, the split cylinder head having reservoir cavities positioned adjacent the intake drum and exhaust drum, the intake drum being fed from both sides of the intake drum for the introduction and interruption of fuel/air mixture into the cylinder, the exhaust drum being evacuated from both sides of the exhaust drum thereby evacuating and interrupting the evacuation of exhaust gases from the cylinder, the intake drum and exhaust drum rotating within the cavities and a gas-tight sealing rotation on an annular sealing means actually positioned about the inlet port and outlet port of the lower section of the split head assembly, respectively.

19 Claims, 8 Drawing Sheets

FIG. 11
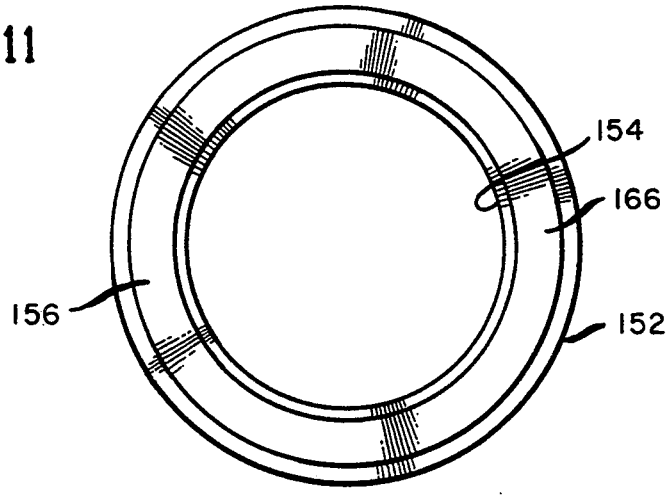
FIG. 12
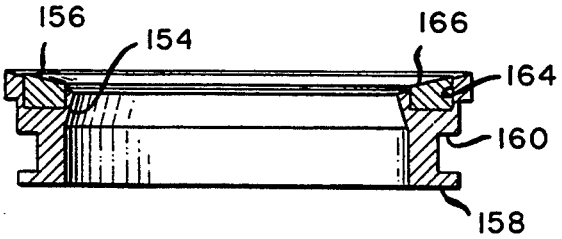
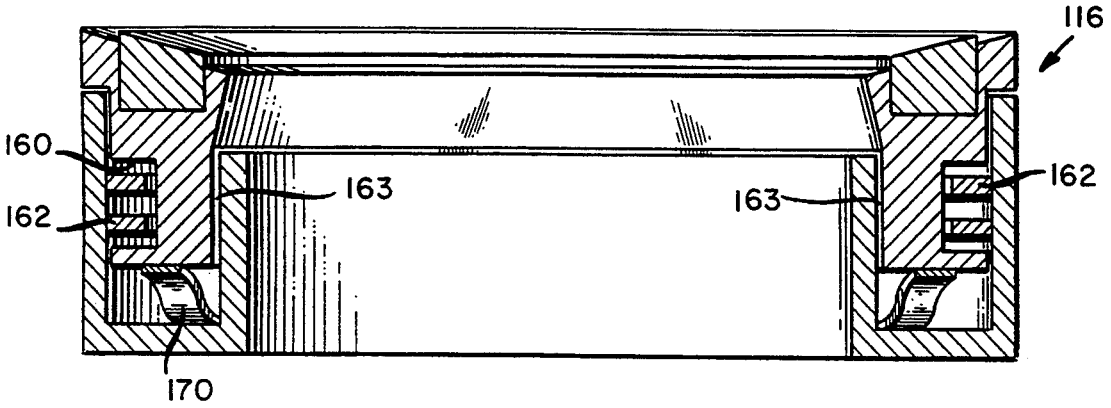
FIG. 13

SPHERICAL ROTARY VALVE ASSEMBLY FOR USE IN A ROTARY VALVE INTERNAL COMBUSTION ENGINE

BACKGROUND OF THE INVENTION

1. Field of the Invention

The present invention relates to an internal combustion engine of the piston and cylinder type and more particularly to an improved spherical rotary valve assembly for use with a rotary valve internal combustion engine for the introduction of the fuel/air mixture to the cylinder and the evacuation of exhaust gases.

2. Description of the Prior Art

In an internal combustion engine of the piston and cylinder type, it is necessary to charge the cylinder with a fuel/air mixture for the combustion cycle and to vent or evacuate the exhaust gases at the exhaust cycle of each cylinder of the engine. In the conventional piston and cylinder type engines, these events occur thousands of times per minute per cylinder. In the conventional internal combustion engine, the rotation of a cam shaft causes a spring-loaded valve to open to enable the fuel and air mixture to flow from the carburetor to the cylinder and combustion chamber during the induction stroke. This cam shaft closes this intake valve during the compression and combustion stroke of the cylinder and the same cam shaft opens another spring-loaded valve, the exhaust valve, in order to evacuate the cylinder after compression and combustion have occurred. These exhaust gases exit the cylinder and enter the exhaust manifold.

The hardware associated with the efficient operation of conventional internal combustion engines having spring-loaded valves includes such items as springs, cotters, guides, rocker shafts and valves themselves which are usually positioned in the cylinder head such that they normally operate in a substantially vertical position with their opening descending into the cylinder for the introduction or venting or evacuation of gases.

As the revolution of the engine increase, the valves open and close more frequently and the timing and tolerances become critical in order to prevent the inadvertent contact of the piston with an open valve which can cause serious engine damage. With respect to the aforementioned hardware and operation, it is normal practice for each cylinder to have one exhaust valve and one intake valve with the associated hardware mentioned heretofore; however, many internal combustion engines have now progressed to multiple valve systems, each having the associated hardware and multiple cam shafts.

In the standard internal combustion engine, the cam shaft is rotated by the crankshaft by means of a timing belt or chain. The operation of this cam shaft and the associated valves operated by the cam shaft presents the opportunity to decrease engine efficiency through friction associated with the operation of the various elements.

Applicant has developed a rotary valve assembly for use with internal combustion engines; U.S. Pat. Nos. 4,944,261; 4,953,527; 4,989,558 and 4,976,232. Applicant's spherical rotary valve assembly eliminates much of the hardware associated with the conventional and standard poppet valve assembly used in conventional automobiles. The advantages of Applicant's spherical rotary valves have been set forth in the prior cited United States patents.

Not only do the spherical rotary valves of Applicant reduce the number of parts required for the operation of an internal combustion engine, but Applicant's spherical rotary valves increase efficiency and decrease emissions.

The present application is directed towards an improved spherical rotary valve for use with Applicant's assembly which allows the intake valve to be fed with a fuel/air mixture from both sides of the intake valve in order to improve the breathing of the engine and the charging of the cylinder with the fuel/air mixture; and permits the exhaust valve to be evacuated from both sides of the valve to improve the evacuation of the spent mixture and to simultaneously decrease the operating temperature of the exhaust rotary valve to further decrease emissions.

OBJECTS OF THE INVENTION

An object of the present invention is to provide for a novel and uniquely improved spherical rotary valve for use with a rotary valve assembly for an internal combustion engine.

Another object of the present invention is to provide for a novel and uniquely improved spherical rotary valve which permits the intake valve to be fed with a fuel and air mixture simultaneously from both sides of the valve.

Another object of the present invention is to provide for a novel and uniquely improved spherical rotary valve for use with a rotary valve assembly for an internal combustion engine in which the exhaust valve is evacuated from both sides of the valve to improve the evacuation of spent gases from the cylinder and to maintain the temperature of the exhaust valve at a lower temperature.

A still further object of the present invention is to provide for a novel and uniquely improved spherical rotary valve for use with a rotary valve assembly for internal combustion engines in which the weight of the improved rotary valves is decreased.

A further object of the present invention is to provide for a novel and uniquely improved spherical rotary valve for use with a rotary valve assembly for internal combustion engines in which the internal passageways of the spherical rotary valve improve the introduction of the fuel/air mixture to the cylinder and improve the evacuation of the spent gases from the cylinder.

SUMMARY OF THE INVENTION

An improved spherical rotary valve for use with an internal combustion engine with improved sealing means which permits the introduction of fuel/air mixture into the cylinder from both lateral sides of the intake spherical rotary valve and permits the evacuation of the spent exhaust gases from the cylinder from both sides of the exhaust spherical rotary valve, the exhaust spherical rotary valve having the capability of providing additional impetus to the flow of exhaust gases to the exhaust manifold.

BRIEF DESCRIPTION OF THE DRAWINGS

The objects of the invention as well as other benefits will become evident after consideration of the following drawings wherein.

FIG. 11 is a top of the sealing means for the improved spherical rotary valve; and FIG. 12 is a side cutaway view of the sealing means.

FIG. 13 is a side cutaway view of the sealing means positioned in the cylinder head.

DETAILED DESCRIPTION OF TEE DRAWINGS

Figure 3:
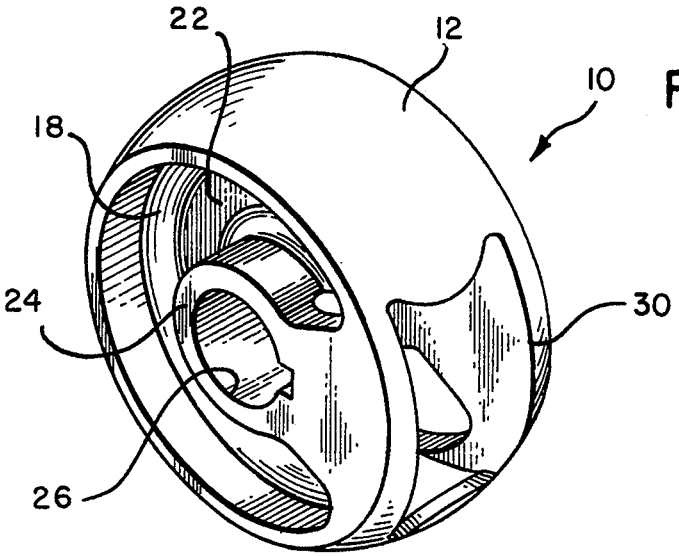
FIG. 3 is a perspective view of the improved intake spherical rotary valve.
Figure 1:
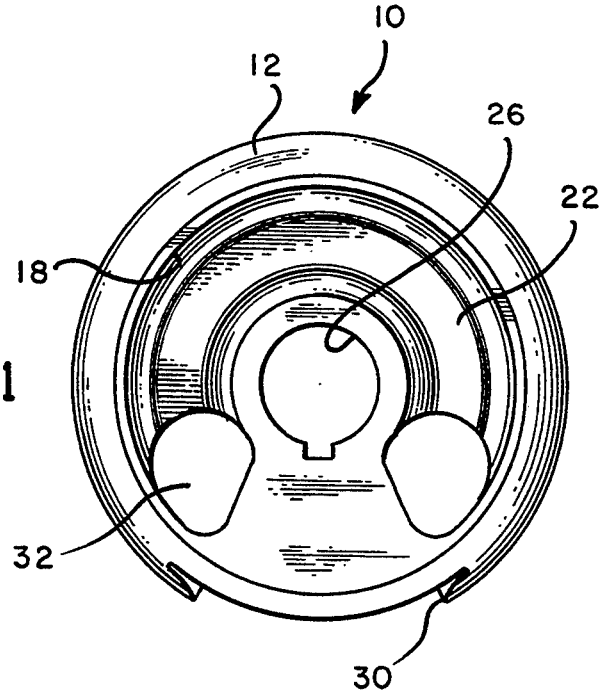
FIG. 1 is a side view of the improved intake spherical rotary valve.
Figure 2:
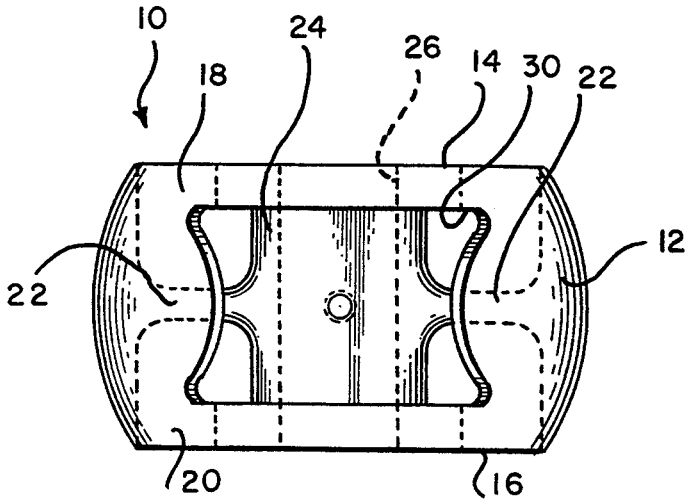
FIG. 2 is an end view of the improved intake spherical rotary valve.

Considering FIGS. 1, 2 and 3, there is illustrated a side view, end view, and perspective view of an intake spherical drum which is the subject of the present invention. Intake spherical drum 10 is defined by a spherical section formed by two parallel sidewalls 14 and 16 disposed about the spherical center, thereby defining a spherical circumferential end wall 12. Sidewalls 14 and 16, respectively have depending inwardly therefrom, circular doughnut-shaped cavities 18 and 20. Circular doughnut-shaped cavities 18 and 20 are separated within intake spherical drum 10 by a partition wall 22 positioned within intake spherical drum 10 an equi distance from annular sidewalls 14 and 16.

Partition wall 22 has positioned centrally therethrough, a shaft mounting element 24, the length of which is complimentary with the width of spherical end wall 12. Central shaft mounting element 24 has an axial throughbore 26 positioned therethrough. Central shaft mounting element 24 and axial throughbore 26 provide the means for mounting intake spherical drum 10 on a centrally-disposed shaft 28 (not shown) to provide for the rotational disposition of intake spherical drum 10 for the introduction of fuel and air mixture into an automotive cylinder as more further described hereafter.

Spherical circumferential end wall 12 has positioned on its surface an aperture 30 for communication with circular doughnut-shaped cavities 18 and 20. Partition wall 22 has a passageway defined therethrough for communication between circular doughnut-shaped cavities 18 and 20. This passageway 32 being positioned in partition wall 22 adjacent aperture 30 in spherical circumferential end wall 12.

In this configuration, both circular doughnut-shaped cavities 18 and 20 will be in communication with a source of fuel/air mixture or air mixture from an intake manifold, for introduction into the cylinder of an internal combustion engine. Intake spherical drum 10 can therefore be fed the fuel/air mixture or air mixture from both sides of the drum.

Aperture 30 in spherical end wall 12 will communicate with the inlet opening of the cylinder of the internal combustion engine as a result of the rotation of intake spherical drum 10 on shaft 28. The intake aperture will permit the fuel/air mixture or air mixture, in the case of fuel-injected engines, to pass from circular doughnut-shaped cavities 18 and 20 through aperture 30 and into the cylinder.

Further rotation of spherical intake drum 10 will move the intake aperture 30 away from the inlet to the cylinder with the spherical circumferential end wall 12 of intake spherical drum 10 causing a seal with the inlet to the cylinder, thus interrupting the flow of the fuel/air mixture into the cylinder. The fuel air mixture or air mixture will continue to flow from the intake manifold into circular doughnut-shaped cavities 18 and 20 of intake spherical drum 10 for introduction into the cylinder on the next rotation of the spherical intake drum 10 when intake aperture 30 again becomes complimentary with the inlet to the chamber.

Figure 6:
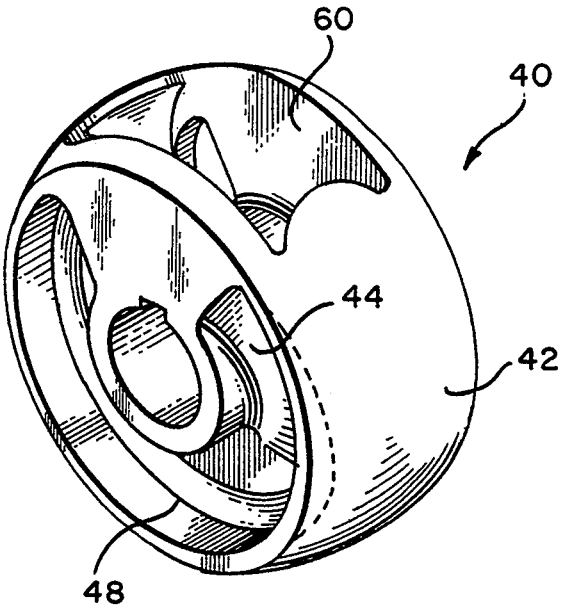
FIG. 6 is a perspective view of the improved exhaust spherical rotary valve.
Figure 4:
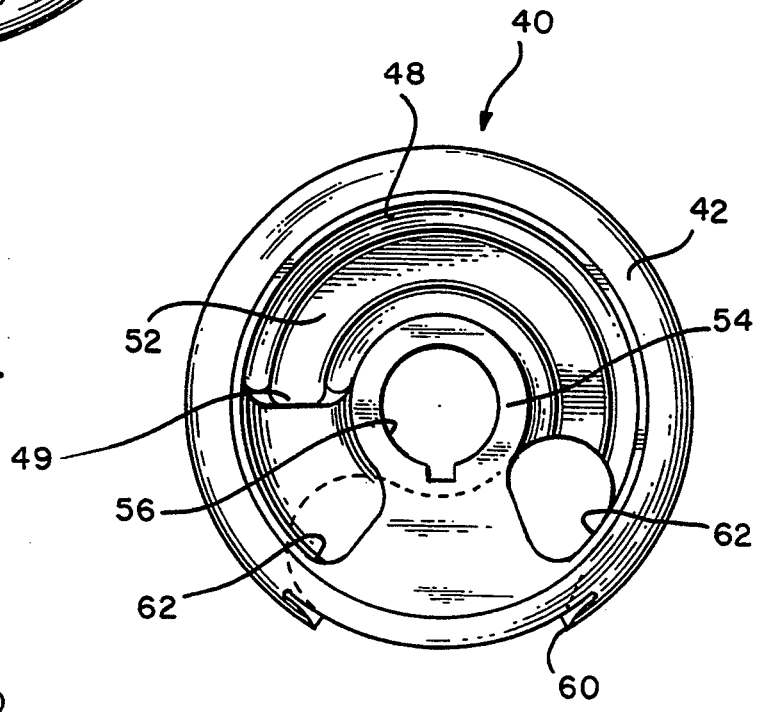
FIG. 4 is a side view of the improved exhaust spherical rotary valve.
Figure 5:
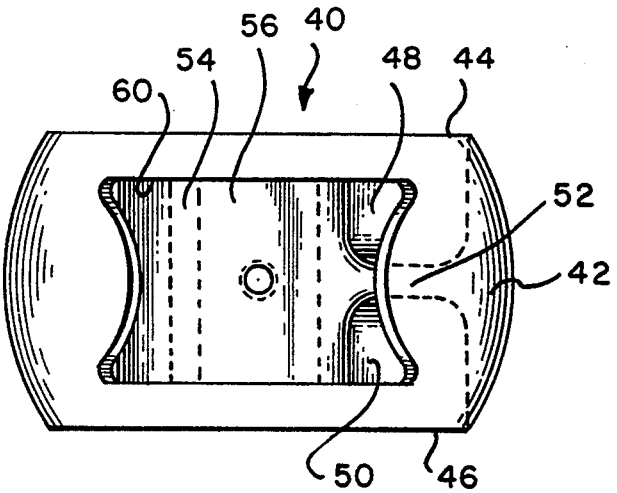
FIG. 5 is an end view of the improved exhaust spherical rotary valve.

Considering FIGS. 4, 5 and 6, there is illustrated a side view, end view and perspective view of an exhaust spherical drum 40 which is the subject of the present invention. Exhaust spherical drum 40 is defined by a spherical section formed by two (2) parallel sidewalls 44 and 46 disposed about the spherical center, thereby defining a spherical circumferential end wall 42. Sidewalls 44 and 46, respectively, have depending inwardly therefrom, cavities 48 and 50. Cavities 48 and 50 are separated within exhaust spherical drum 40 by a partition wall 52 positioned within exhaust spherical drum 40.

Partition wall 52 has positioned centrally therethrough a shaft mounting element 54, the length of which is complimentary with the width of spherical end wall 42. Central shaft mounting element 54 has an axial throughbore 56 positioned therethrough. Central shaft mounting element 54 and axial throughbore 56 provide the means for mounting exhaust spherical drum 40 on a centrally-disposed shaft 28 (not shown) to provide for the rotational disposition of exhaust spherical drum 40 for the evacuation of spent gases from an automotive cylinder as more further described hereafter.

Spherical circumferential end wall 42 has positioned on its surface, an aperture 60 for communication with cavities 48 and 50. Partition wall 52 has a passageway defined therethrough for communication between cavities 48 and 50. This passageway 62 is positioned in the partition wall 52 adjacent aperture 60 in spherical circumferential end wall 42.

In this configuration, both cavities 48 and 50 will be in communication with an exhaust manifold for the evacuation of spent gases from the cylinder of an internal combustion engine. Exhaust spherical drum 40 can therefore evacuate the spent gases from a cylinder utilizing both sides of the drum.

Aperture 60 and spherical end wall 42, in operation, will communicate with the outlet opening of the cylinder of the internal combustion engine as a result of the rotation of the exhaust spherical drum 40 on shaft 58. The exhaust aperture will permit the spent gases to pass from the cylinder, through aperture 60, and thence cavities 48 and 50 to the exhaust manifold.

The further rotation of exhaust spherical drum 40 will move the exhaust aperture 60 away from the outlet to the cylinder with spherical circumferential end wall 42 of exhaust spherical drum 40 causing a seal with the outlet from the cylinder, thus, interrupting the evacuation of the spent gases from the cylinder. With the exhaust spherical drum 40 in the closed or interrupted state, the cylinder would undergo its charging and compression/power stroke, and the further rotation of the exhaust spherical drum 40 would bring aperture 60 into contact with the exhaust outlet of the cylinder so as to permit the spent gases to be released from the cylinder during the exhaust stroke, through the outlet port of the cylinder, through aperture 60, and thence along cavities 48 and 50 to the exhaust manifold.

In the preferred embodiment, cavities 48 and 50 would vary in depth from annular sidewalls 44 and 46 to partition wall 52 in order to encourage the evacuation of exhaust gases. Partition wall 52 would define the maximum depth in cavities 48 and 50 immediately adjacent the edge of aperture 60 which would rotate into initial alignment with outlet opening of the cylinder. The depth of cavities 48 and 50 would decrease such that there would be a plug 49 and 51 formed in cavities 48 and 50 adjacent the opposite edge of aperture 60. This opposite edge of aperture 60 being that portion which is last in communication with the outlet opening of the cylinder during rotation. The incline within cavities 48 and 50 could be gradually helical shaped or a severe upslope proximate to plugs 49 and 51. The purpose is to provide a thrust effect to encourage rapid evacuation of exhaust gases to the manifold. It should be understood that the exhaust valve would also function with cavities 48 and 50 at a fixed depth. Plugs 49 and 51 are a preferable embodiment in order to impart additional thrust to the exhaust gases.

The concept of the spherical rotary valve is to eliminate the need for push-rod valves and their associated hardware and to provide a means for charging the cylinder for its power stroke and evacuating the cylinder during its exhaust stroke. As will be more apparent hereafter with reference to FIG. 7, intake spherical drum 10, and in particular, cavities 18 and 20 are in constant communication with the incoming fuel/air mixture from inlet port 114 from the carburetor and this fuel/air mixture in cavities 18 and 20 is introduced into the cylinder when inlet aperture 30 comes into rotational alignment with the inlet port in lower half of the cylinder head as described hereafter. When intake aperture 30 is not in alignment with the inlet port of the cylinder, arcuate circumferential periphery of end wall 12 serves to seal the inlet port of the cylinder. With respect to the exhaust stroke of the cylinder, the arcuate circumferential periphery of end wall 42 of exhaust spherical drum 40 maintains a seal on the exhaust port of the cylinder until exhaust aperture 60 on the arcuate circumferential periphery of exhaust spherical drum 40 comes into rotational alignment with the exhaust port of the cylinder positioned in the lower half of the cylinder head. The exhaust stroke of the piston then forces the evacuation of the gases through the exhaust port into cavities 48 and 50 of exhaust spherical drum 40 and thence to the exhaust manifold 120. It will be recognized by one skilled in the art that the positioning of intake aperture 30 on intake spherical drum 10 and exhaust aperture 60 on exhaust spherical drum 40 is done with respect to the power strokes and exhaust strokes of the piston within the cylinder and the timing requirements of the engine.

Figure 8:
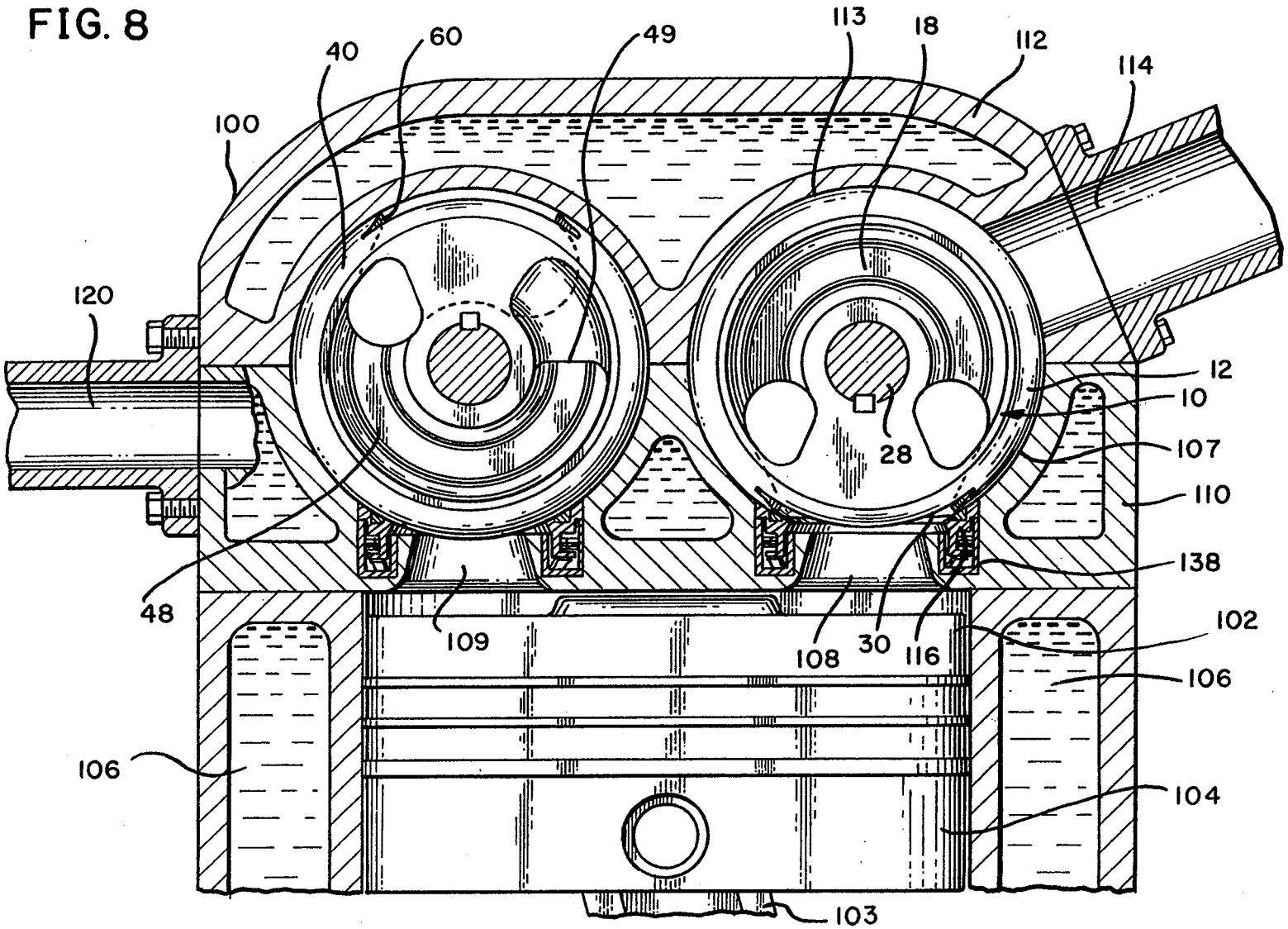
FIG. 8 is a side, cross-sectional view of a cylinder head assembly illustrating the relationship between the intake and exhaust spherical rotary valve.

Referring to FIG. 8, there is shown a side sectional view of the cylinder and cylinder head with internal piston in conjunction with the intake spherical drum 10. The cylinder and piston and block are similar to that of a conventional internal combustion engine. There is shown an engine block 100 having disposed therein a cylinder cavity 102 there being positioned within cylinder cavity 102, a reciprocating piston 104 which is secured to a crankshaft 103 and which moves in a reciprocating action within cylinder cavity 102. The cylinder cavity itself is surrounded by a plurality of enclosed passageways 106 designed to permit the passage therethrough of a cooling fluid to maintain the temperature of the engine. As will be recognized by one skilled in the art, when the head is removed from an internal combustion engine, the cylinder cavity and piston enclosed therein can be viewed. Applicant's engine head is a split head comprised of a lower section 110 which is secured to the engine block 100 and contains an intake port 108 for cylinder 102. Intake port 108 is positioned in a hemispherical drum-accommodating cavity 107 defined by the inner section of two perpendicular parallel planes in order to accommodate the positioning of intake spherical drum 10. The upper half 112 of the split head assembly also contains a hemispherical drum-accommodating cavity 113 defined by the inner section of two parallel planes in order to define a cavity for receipt of the upper half of intake spherical drum 10. When upper half 112 and lower half 110 of the head are secured to the engine block by standard head bolts, intake spherical drum 10 is rotationally encapsulated within the cavity defined by the two halves of the split head assembly.

Figure 7:
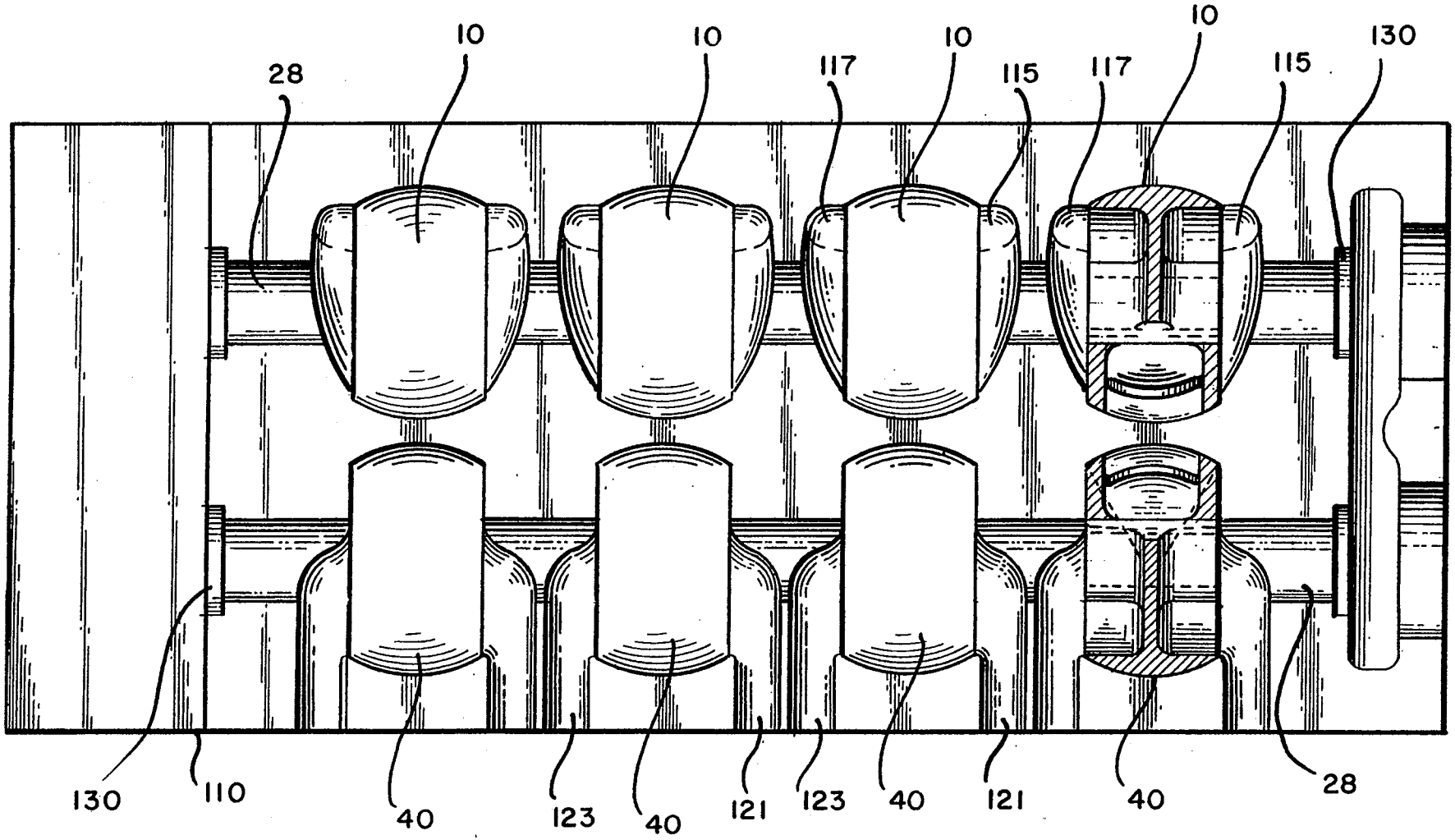
FIG. 7 is a top view of a 4-cylinder split head assembly illustrating the manner in which the intake spherical rotary valves are set with a fuel/air mixture and the manner in which the exhaust spherical rotary valves are evacuated of exhaust gases.

There is formed in upper and lower split head assemblies 112 and 110, a cavity coincidental with sidewalls 14 and 16 and hence with cavities 18 and 20 in intake spherical drum 10. These cavities 115 and 117 are in communication with the intake manifold and an inlet port 114 to permit the fuel/air mixture to flow into cavities 18 and 20 of inlet spherical drum 10. In this manner, inlet spherical drum 10 is in constant communication with the source of fuel/air mixture being fed into cavities 18 and 20 such that when intake aperture 30 on circumferential end wall periphery 12 of intake spherical drum 10 comes into alignment with the inlet port to the cylinder, the fuel/air mixture is positioned for introduction into the cylinder. This arrangement is best illustrated in FIG. 7.

A sealing mechanism 116 as described hereafter is positioned about inlet port 108 to cylinder cavity 102 in order to provide an effective seal during the rotational disposition of intake spherical drum 10. Sealing mechanism 116 provides an effective seal with the circumferential periphery of end wall 12 of intake spherical drum 10.

In this configuration, cavities 18 and 20 on intake spherical drum 10 are continually charged with a fuel/air mixture through inlet port 114. This fuel/air mixture is not introduced into cylinder cavity 102 until intake aperture 30 comes into rotational alignment with inlet port 108 to the cylinder 120. Sealing mechanism 116 cooperates with the arcuate circumferential periphery 12 of intake spherical drum 10 to provide the effective gas tight seal to ensure the fuel/air mixture passes from cavities 18 and 20 through inlet port 108 and into cylinder cavity 102. In normal operation, this introduction occurs with the downward movement of piston 104 during the intake stroke thus charging the cylinder with the fuel/air mixture. As soon as the inlet aperture 30 has been closed such that it no longer is in alignment with inlet port 108 to the cylinder, the arcuate spherical circumferential periphery 12 of intake spherical drum 10 would seal the inlet port in cooperation with seal 116 in preparation for the power stroke of piston 104 and the ignition of the fuel/air mixture. The rotation of intake spherical drum 10 is accomplished by means of shaft 28 upon which intake spherical drum 10 is mounted. Shaft 28 in communication with a timing chain or other similar device and the crankshaft to which the pistons 104 are mounted ensures the appropriate timing of the opening and closing of inlet port 108 by means of alignment with inlet aperture 30 on intake spherical drum 10.

Exhaust spherical drum 40 is disposed within the same engine block 100 having a cylinder cavity 102 disposed therein in a reciprocating piston 104 within the cylinder cavity 102. Lower and upper heads 110 and 112 are secured to the engine block 100. Exhaust spherical drum 40 is rotationally disposed within the lower half and upper half 110 and 112 of the split head assembly in a drum accommodating cavity 107 and 113 similar to the intake spherical drum 10. Exhaust spherical drum 40 is in communication with an exhaust port 109 for cylinder cavity 102.

In the exhaust mode, piston 104 has completed its power stroke, thus compressing and igniting the fuel/air mixture within the cylinder. This power stroke is accomplished with the arcuate spherical circumferential periphery of intake spherical drum 10 and exhaust spherical drum 30 providing the required sealing closure of the respective intake port 108 and exhaust port 109. The ignition of the fuel/air mixture serves to drive piston 104 downwardly within cylinder cavity 102 and thence piston 104 begins its ascent in the exhaust stroke. Exhaust spherical drum 40 rotating on shaft 28 and in timing communication with the crankshaft rotates to bring aperture 60 on the spherical periphery of exhaust drum 40 in communication with exhaust port 109. In this configuration, a conduit passageway is defined through the exhaust spherical drum 40 from exhaust port 109 at the top of the cylinder head with the spent gases being exhausted from the cylinder through exhaust port 109, through aperture 60, and into cavities 48 and 50. Thence to exhaust conduit 120 through chambers 121 and 123 on opposing sides of exhaust valve 40 which exit to the exhaust manifold and to the ambient atmosphere (see FIG. 7). The initial opening of exhaust spherical drum 40 introduces spent gases into cavities 48 and 50 at the point where their depth is greatest. As previously explained, cavities 48 and 50 gradually decrease in depth until a seal is formed by plug walls 49 and 51. This design serves to accelerate the exhaust gases through spherical exhaust drum 40 in order to hasten the evacuation of cylinder cavity 102. Upon completion of the evacuation of cylinder cavity 102, the circumferential periphery end wall 42 of exhaust spherical drum 40 again contacts a sealing means 116, similar to that of the intake spherical drum 10 to form a seal with respect to exhaust port 109 until the next exhaust stroke of piston 104 occurs within cylinder cavity 102.

Figure 9:
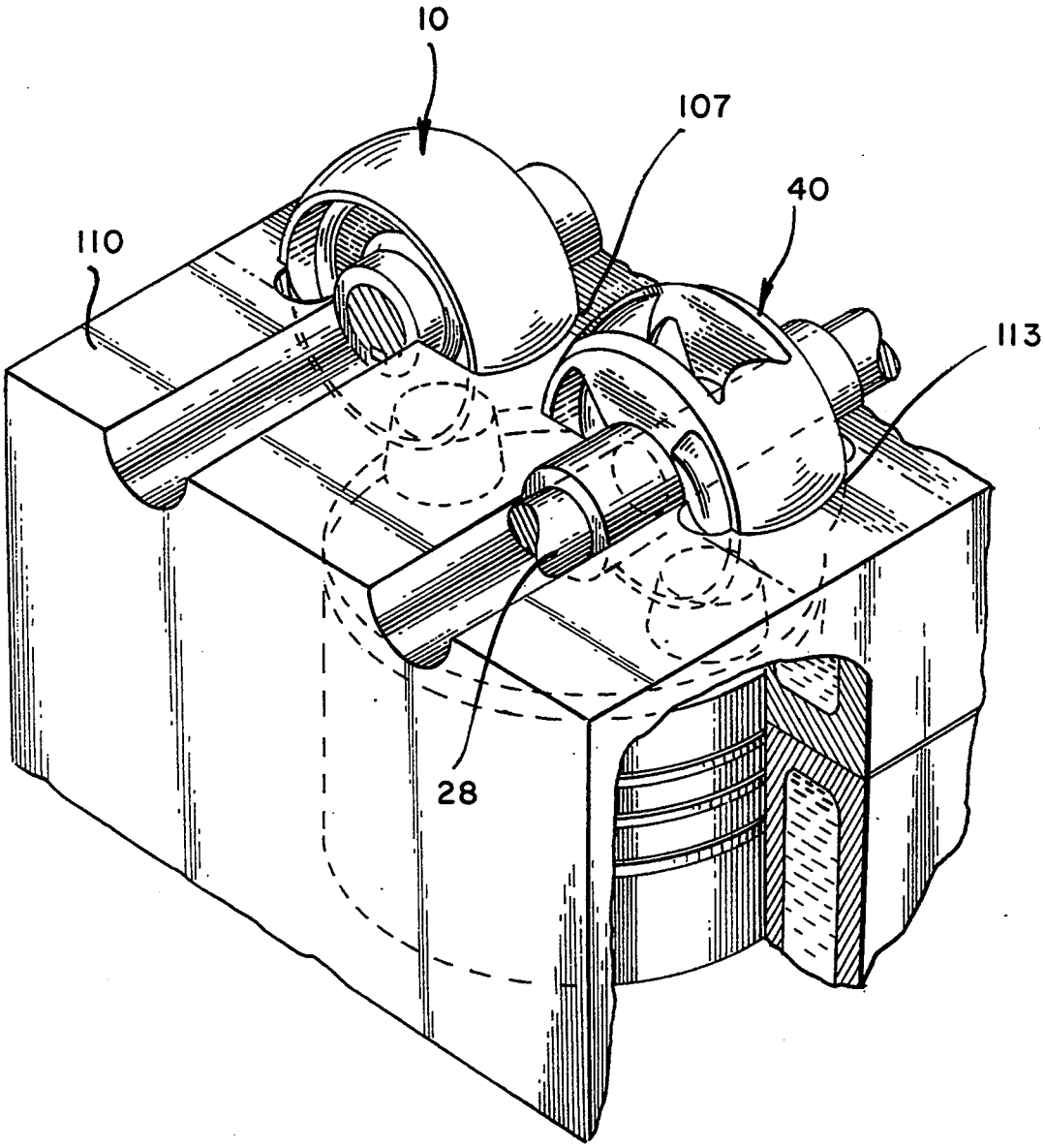
FIG. 9 is a perspective view of a cylinder head assembly illustrating the relationship of the intake and exhaust spherical rotary valve.

FIG. 9 is a perspective view of a paired intake spherical drum 10 and exhaust spherical drum 40 positioned within the lower section 110 of the split head assembly with respect to a single cylinder. Similarly, it will be recognized by one of ordinary skill in the art that if a V-6 or V-8 or V-12 engine or the like is utilized, each bank of cylinders would have a similarly-positioned spherical rotary valve assembly associated therewith. Another embodiment of the invention would be to provide the intake spherical drums 10 and the exhaust spherical drums 40 would be positioned on a single shaft if the size of the engine were such so that the twin feeding of the intake valve and the twin exhausting of the exhaust valve could be accomplished without affecting the structure integrity of the engine.

Shaft 28 and rotary spherical drums 10 and 40 are supported in a split head assembly by a plurality of bearing surfaces 130. Spherical drums 10 and 40 are machined as is the drum accommodating cavities 107 and 113, the tolerances between the spherical drums and the cavities being approximately 1/1000th of an inch. When shaft 28 and the spherical drum assembly is positioned within the split head, shaft 28 contacts bearing surfaces 130 and spherical drums 10 and 40, respectively are in contact with only the sealing means 116, the embodiments of which are described hereafter.

Figures 10A, 10B, 10C, 10D:
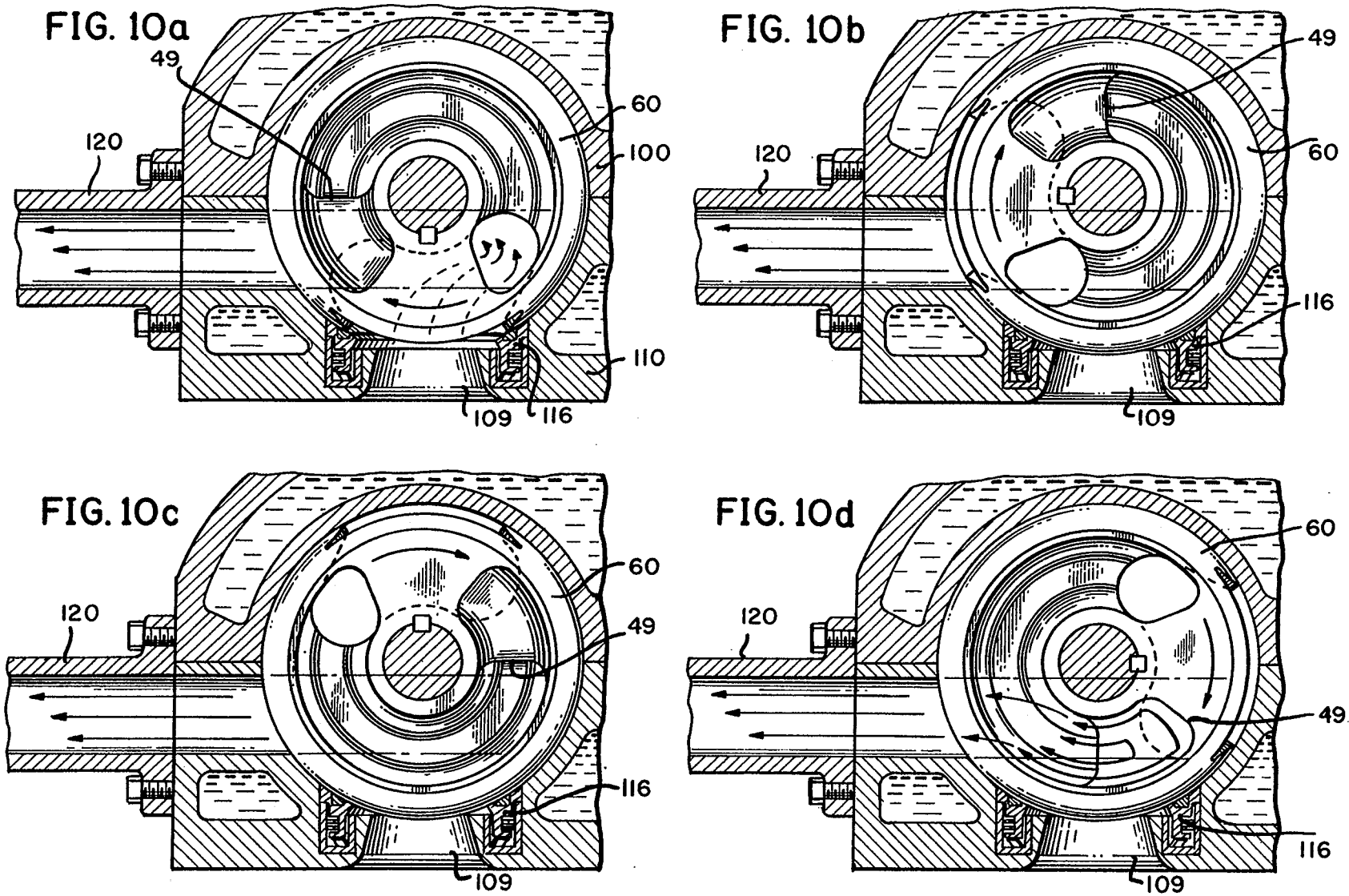
FIG. 10*a* through *d* is a side view of the exhaust rotary valve illustrating sequentially the manner in which the exhaust gases are evacuated from the cylinder.

FIG. 10*a, b, c* and d illustrates the manner in which the exhaust gases are evacuated from the cylinder through exhaust drum 40 and thence to the exhaust manifold. FIG. 10 illustrates the manner in which the airflow exits cylinder 102 through exhaust outlet 109 and through aperture 60 on the spherical periphery of exhaust drum 40, thus entering cavities 48 and 50 of exhaust drum 40. The spent exhaust gases then exit cavities 48 and 50 by way of exhaust chambers 121 and 123, respectively (see FIG. 7). These exhaust gases are given a final impetus by means of plugs 49 and 51 immediately prior to the exhaust process commencing anew with the alignment of aperture 60 with exhaust port 109.

Figure 14:
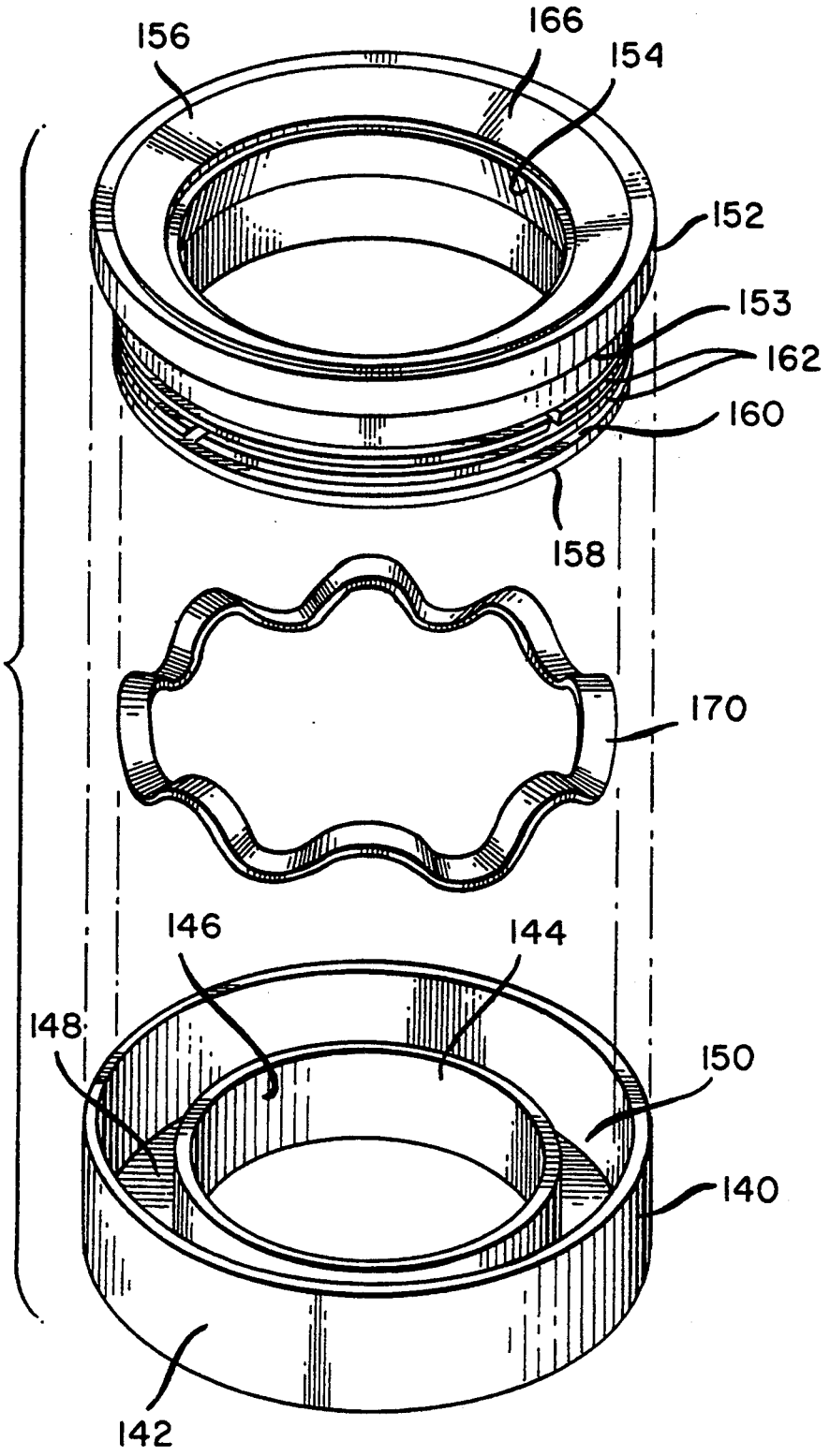
FIG. 14 is a perspective exploded view of the sealing means.

FIG. 11, 12 and 13 are a top view, side cutaway view, and side cutaway view within the cylinder head illustrating sealing means 116 and FIG. 14 is an exploded perspective view of sealing means 116. The description of sealing means 116 is made herein with respect to the rotary intake valve 10, but sealing means 116 is of the same design and serves the same purpose and function with respect to its relationship with the rotary exhaust valve 40.

Sealing means 116 is comprised of two primary members. A lower receiving ring 140 is configured to be received within annular groove 138 in the lower half of the split head assembly and circumferentially positioned about inlet port 108. Inner circumferential wall 144 and outer circumferential wall 142 are secured by a planar circumferential base 148 thereby defining an annular receiving groove 150 for receipt of the upper valve seal ring 152.

Upper valve seal ring 152 has a centrally-disposed aperture 154 in alignment with aperture 146 and lower receiving member 140. The outer wall 153 of upper valve seal 152 is stepped inwardly from upper surface 156 to lower surface 158 in order to define an annular groove 160 for receipt of a blast ring 162. Upper valve seal member 152 is designed to fit within annular groove 150 in lower valve seal receiving member 140.

The upper surface 156 of upper valve seal ring 152 is curved inwardly towards the center of aperture 154, the upper surface having an annular indent 164 for the receipt of a carbon insert lubricating ring 166. Carbon insert lubricating ring 166 extends above upper surface 156 of upper valve seal ring 152 and contacts the spherical peripheral surface of the rotary intake valve 10. The curvature of upper surface 156 is such that it conforms to the peripheral curvature of intake rotary valve 10 with carbon insert lubricating ring 166 in intimate contact with the peripheral surface of rotary intake valve 10.

The contact between carbon insert lubricating ring 166 and the peripheral surface of rotary intake valve 10 is maintained by annular beveled springs 170 positioned in the annular receiving groove 150 below upper valve seal ring 152. The pressure to be maintained upwardly on the upper valve seal ring 152 is in the range of between 1 to 4 ounces. As such, this pressure can be accomplished by either a single bevel spring located in annular receiving groove 150 or a plurality of annular beveled springs.

Upper valve seal ring 152 has positioned about annular groove 160, a blast ring 162 which functions similar to a piston ring associated with a piston. Blast ring 162 serves to provide additional sealing contact between valve seal 116 and the peripheral surface of rotary intake valve 10 and the rotary exhaust valve during the compression and power stroke. The increased gas pressure within the cylinder and within annular groove 150 will increase the pressure below the blast ring 162 which forms a seal with the outer circumferential wall 142 preventing the escape of gases, and yet providing an upward force on upper valve seal ring 152, thus forcing a better contact seal between the carbon insert ring 164 and the peripheral surface of rotary intake valve 10. The same interaction will occur with the valve seal associated with rotary exhaust valve 40. During the intake and exhaust stroke, the carbon insert ring 64 will be maintained in contact with the rotary exhaust valve by means of beveled springs positioned in annular groove 150.

The upward pressure during the combustion or power stroke is transmitted to upper valve seal ring 152 by means of a compression of the gases in the cylinder and an inlet port 102 by means of passageway 163 between the upper valve seal ring 152 and lower receiving ring 140 such that the gases can expand into annular receiving groove 50 beneath upper valve seal 52, but are presented from escaping by means of blast ring 60 in contact with the outer circumferential wall 142 of lower receiving ring 140. This provides additional pressure along with bevel spring 170 in providing contact between carbon insert 166 and the peripheral surface of the valve.

The configuration of sealing means 116 provides for an intimate seal with the rotary intake and rotary exhaust valve and in fact, is the only contact with the intake rotary valve or exhaust rotary valve during the course of its revolution within the drum accommodating cavities. This significantly reduces the number of mechanical parts within the engine and thereby reduces the friction encountered in the operation of the engine.

While the present invention has been described in connection with the exemplary embodiments thereof, it will be understood that many modifications be apparent to those of ordinary skill in the art and the application is intended to cover any adaptations or variations thereof. Therefore, it is manifestly intended that this invention be only limited by the claims and the equivalents thereof.

What is claimed is:

1. An improved spherical rotary valve assembly for use in internal combustion engines of the piston and cylinder type, said spherical rotary valve assembly comprising:

a removable two-piece cylinder head securable to the internal combustion engine, said two-piece removable cylinder head comprising an upper and lower cylinder head section; said upper and lower cylinder head sections, when secured to said internal combustion engine, define two cavities radially aligned with the cylinders of said internal combustion engine, said cavities defining a plurality of first drum accommodating cavities for receipt of radially-aligned rotary intake valves and second radially-aligned cavities defining a plurality of second drum accommodating cavities for receipt of a plurality of radially-aligned rotary exhaust valves, said lower cylinder head section and said plurality of first drum accommodating cavities having an inlet port in communication with said cylinder; said lower cylinder head section and said second drum accommodating cavities having an outlet port in communication with said cylinder;

a sealing means associated with said inlet and said outlet ports;

a first passageway for introduction of a fuel/air mixture into said cylinder head by way of a reservoir cavity adjacent both sides of said first drum accommodating cavity and said rotary intake valve and a second passageway for the evacuation of exhaust gases from said cylinder by way of an evacuation cavity adjacent both sides of said second drum accommodating cavity and said rotary exhaust valve;

a first shaft means journaled on bearing surfaces within said first cavity, radially aligned with said cylinders of said internal combustion engine, said first shaft means having mounted thereon a plurality of said rotary intake valves;

a second shaft means journaled on said bearing surfaces within said second radially-aligned cavity, said second shaft means having positioned thereon a plurality of said rotary exhaust valves;

said rotary intake valve and said rotary exhaust valve each having a spherical section defined by two parallel planes of a sphere, said planes being disposed symmetrically about the center of said sphere, defining a spherical periphery and planer side walls, said rotary intake valves mounted on said first shaft means in said plurality of drum accommodating cavities in gas tight sealing contact with said inlet port, each of said rotary exhaust valves mounted on said second shaft means in said plurality of drum accommodating cavities in gas tight sealing contact with said outlet port, said rotary intake valve having a passageway on its spherical periphery for the introduction and interruption of fuel/air mixture into said engine, said passageway in communication with doughnut cavities formed in both of said sidewalls of said rotary intake valves, said doughnut cavities in communication with adjacent reservoir cavities formed in said upper and lower cylinder head sections, said adjacent reservoir cavities in communication with said first passageway for the introduction of said fuel/air mixture into said cylinder from both sides of said rotary intake valve, said rotary exhaust valve having a passageway positioned on its spherical periphery for the evacuation and interruption of evacuation of exhaust gases from said cylinder, said rotary exhaust valve having doughnut-shaped cavities formed in said planer sidewalls in communication with said passageway on said spherical periphery, said doughnut cavities in communication with adjacent evacuation cavities formed in said upper and lower cylinder head sections, said adjacent evacuation cavities in communication with said second passageway for the evacuation of exhaust gases from said cylinder.

2. An improved rotary valve assembly in accordance with claim 1 wherein said sealing means comprises a receiving ring, substantially circular in cross sectional area having defined therein, an annular receiving groove, said receiving ring engageably secured in said cylinder head about said inlet port with respect to said rotary intake valve and about said exhaust port with respect to said rotary exhaust valve, said receiving ring having an aperture therethrough coincidental with said inlet port or said exhaust port;

a contact ring removably secured within said annular receiving groove of said receiving ring, said contact ring having a curved upper surface conforming to said spherical periphery of said intake valve or said exhaust valve, said contact ring having an aperture therethrough coincidental with said aperture of said receiving ring and said inlet port or said outlet port;

a spring bias means positioned in said annular receiving groove of said receiving ring, positioned below said contact ring and exerting upward pressure on said contact ring;

a sealing means positioned about said contact ring in contact with said outer wall of said annular receiving groove;

a communicating passageway between said inlet port or said outlet port and said sealing means secured to said contact ring.

3. A sealing means in accordance with claim 2 wherein said curved surface of said contact ring complimentary with said peripheral surface of said rotary intake valve or said rotary exhaust valve has annularly positioned therein a carbon fiber insert.

4. A sealing means in accordance with claim 2 wherein said sealing means on said contact ring comprises one or more blast rings removably positioned about said contact ring, said blast rings providing intimate contact with said outer wall of said annular receiving groove of said receiving ring.

5. A sealing means in accordance with claim 2 wherein said spring means positioned in said annular receiving groove below said contact ring comprises one or more beveled springs providing upward pressure on said contact ring engaging said curved surface of said contact ring with said peripheral surface of said rotary intake valve or said rotary exhaust valve.

6. A sealing means in accordance with claim 2 wherein said contact ring is constructed of carbon fiber.

7. A spherical rotary valve assembly in accordance with claim 1 wherein said rotary intake valve for use in said rotary valve internal combustion engine comprising a drum body of spherical section defined by two parallel planes of a sphere disposed symmetrically about the center of said sphere thereby defining a spherical periphery and planar sidewalls and is formed with a shaft receiving aperture centrally, radially disposed therethrough, said drum body formed with a doughnut-shaped cavity in each of said sidewalls thereof about said shaft receiving aperture, said doughnut cavities segregated by a partition wall, said partition wall having a channel extending between said doughnut cavities, said channel in said partition wall positioned adjacent said passageway formed in said spherical periphery.

8. An improved rotary exhaust valve in accordance with claim 1 for use in a rotary valve internal combustion engine comprised of a drum body of spherical section defined by two parallel planes of a sphere disposed symmetrically about the center of said sphere, said drum body thereby defining a spherical periphery and planar sidewalls, said drum body further comprising a shaft receiving aperture centrally, radially disposed therethrough, said drum body formed with doughnut-shaped cavities in each sidewall thereof disposed about said shaft receiving aperture, said doughnut-shaped cavities separated by a partition wall, said partition wall having a channel therethrough, said channel in said partition wall positioned adjacent said passageway formed in said spherical periphery.

9. An improved rotary exhaust valve in accordance with claim 8 wherein said doughnut-shaped cavities in each sidewall have positioned therein a plug wall extending radially outwardly from said shaft receiving aperture to said spherical periphery, said plug wall positioned proximate to said channel in said partition wall, said plug wall imparting additional thrust for the evacuation of said exhaust gases.

10. An improved rotary exhaust valve in accordance with claim 9 wherein said plug wall in said doughnut-shaped cavities is gradually slopped upwardly from said partition wall.

11. A spherical rotary intake valve for use in rotary valve internal combustion engine comprising a drum body of spherical section defined by two parallel planes of a sphere disposed symmetrically about the center of said sphere thereby defining a spherical periphery and planar sidewalls, said rotary intake valve formed with a shaft receiving aperture centrally, radially disposed therethrough, said drum body formed with a doughnut-shaped cavity in each of said sidewalls thereof, about said shaft receiving aperture, said doughnut cavities segregated by a partition wall, said doughnut-shaped cavities in communication with a passageway formed in said spherical periphery of said drum body.

12. The spherical rotary intake valve in accordance with claim 11 wherein said partition wall has a channel passageway therethrough communicating with said doughnut-shaped cavities, said channel in said partition wall positioned proximate to said passageway formed in said spherical periphery of said drum body.

13. The spherical rotary intake valve in accordance with claim 11 wherein said shaft receiving aperture is longitudinally formed on said center extending between said planar sidewalls.

14. The spherical rotary intake valve in accordance with claim 11 wherein said planar sidewalls are symmetrically disposed about said center of said drum body.

15. A spherical rotary exhaust valve for use in rotary valve internal combustion engines comprising a drum body of spherical section defined by two parallel planes of a sphere disposed symmetrically about the center of said sphere thereby defining a spherical periphery and planar sidewalls, said rotary exhaust valve formed with a shaft receiving aperture, centrally, radially disposed therethrough, said drum body formed with a doughnut-shaped cavity in each of said sidewalls thereof, about said shaft receiving aperture, said doughnut-shaped cavity segregated by a partition wall, said doughnut-shaped cavities in communication with a passageway formed in said spherical periphery of said drum body.

16. The spherical rotary exhaust valve in accordance with claim 15 wherein said partition wall has formed therein a channel passageway for communication between said doughnut-shaped cavities, said channel passageway positioned in said partition wall proximate to said passageway formed in said spherical periphery of said drum body.

17. The spherical rotary exhaust valve in accordance with claim 15 wherein said doughnut-shaped cavities have positioned therein, a plug wall extending radially outwardly from said shaft receiving aperture to said spherical periphery, said plug wall positioned proximate to said channel in said partition wall, said plug wall imparting additional thrust for the evacuation of exhaust gases.

18. The spherical rotary exhaust valve in accordance with claim 15, wherein said plug wall in said doughnut-shaped cavities is gradually sloped upwardly from said partition wall.

19. The spherical rotary exhaust valve in accordance with claim 15, wherein said planar sidewalls are symmetrically disposed about said center of said drum body.

* * * * *